US007216791B1

(12) United States Patent
Marks

(10) Patent No.: US 7,216,791 B1
(45) Date of Patent: May 15, 2007

(54) SPRING ENERGIZED STAPLER LEVER FULCRUM IN LOW POSITION

(75) Inventor: Joel S. Marks, Sherman Oaks, CA (US)

(73) Assignee: Worktools, Inc., Chatsworth, CA (US)

( * ) Notice: Subject to any disclaimer, the term of this patent is extended or adjusted under 35 U.S.C. 154(b) by 0 days.

(21) Appl. No.: 11/040,122

(22) Filed: Jan. 21, 2005

(51) Int. Cl.
*B25C 5/06* (2006.01)

(52) U.S. Cl. ..... 227/132; 227/120

(58) Field of Classification Search ..... 227/132, 227/134, 120, 156
See application file for complete search history.

(56) References Cited

U.S. PATENT DOCUMENTS

| | | | | |
|---|---|---|---|---|
| 1,956,174 | A | 4/1934 | Maynard | |
| 2,142,782 | A | 1/1939 | Gillene | |
| 2,218,794 | A | 10/1940 | Kilbride | |
| 2,271,479 | A | 1/1942 | Gambao | |
| 2,421,429 | A | 6/1947 | Obstfeld | |
| 2,493,640 | A * | 1/1950 | Peterson | 227/132 |
| 2,657,384 | A | 11/1953 | Boroughs | |
| 2,726,391 | A | 12/1955 | Pilblad | |
| 2,733,440 | A | 2/1956 | Jenny | |
| 2,884,636 | A | 5/1959 | Abrams | |
| D186,342 | S | 10/1959 | Marano | |
| 2,915,753 | A | 12/1959 | Ruskin | |
| 3,034,128 | A | 5/1962 | Robbins | |
| 3,630,428 | A | 12/1971 | Olney et al. | |
| 3,758,016 | A | 9/1973 | Olney et al. | |
| D243,148 | S | 1/1977 | Levin | |
| 4,025,031 | A * | 5/1977 | Chi | 227/132 |
| 4,156,499 | A | 5/1979 | Frank | |
| 4,206,863 | A | 6/1980 | Savino | |
| 4,463,890 | A | 8/1984 | Ruskin | |
| 4,546,909 | A | 10/1985 | Ebihara | |
| 4,598,852 | A | 7/1986 | Olesen | |
| 4,666,075 | A | 5/1987 | Olesen | |
| 4,795,073 | A | 1/1989 | Yamamoto et al. | |
| 4,811,884 | A | 3/1989 | Sato | |
| 5,004,142 | A | 4/1991 | Olesen | |
| 5,356,063 | A | 10/1994 | Perez | |
| 5,497,932 | A * | 3/1996 | Brewer et al. | 227/132 |
| 5,699,949 | A | 12/1997 | Marks | |

(Continued)

FOREIGN PATENT DOCUMENTS

| | | |
|---|---|---|
| DE | 28 56 621 | 7/1980 |

(Continued)

*Primary Examiner*—John Sipos
*Assistant Examiner*—Michelle Lopez
(74) *Attorney, Agent, or Firm*—Paul Y. Feng; Fulwider Patton LLP

(57) ABSTRACT

A spring actuated stapler includes a lever releasably linked to a striker at a lever front end. An elongated power spring is linked to the striker so that raising the lever front end deflects the power spring. The lever and power spring pivot about a common fulcrum structure. The fulcrum structure includes a rear facing surface and the lever pivots about the rear facing surface when the lever is near a lever release point. This pivot location is adjacent to the power spring, at a bottom of the structure of the fulcrum. With the lowest possible pivot location the lever retracts and releases from the striker more quickly than if the lever pivots about a higher location at a fulcrum "axial center". The release action is therefore more consistent, and less sensitive to manufacturing variations of the stapler.

6 Claims, 3 Drawing Sheets

U.S. PATENT DOCUMENTS

| | | | | |
|---|---|---|---|---|
| 5,715,982 | A | 2/1998 | Adachi | |
| 5,765,742 | A * | 6/1998 | Marks | 227/132 |
| 5,816,470 | A | 10/1998 | Plato et al. | |
| D413,239 | S | 8/1999 | Lovegrove et al. | |
| 5,931,364 | A | 8/1999 | Dennis | |
| 5,979,736 | A | 11/1999 | Edeholt | |
| 5,988,478 | A | 11/1999 | Marks | |
| 6,145,728 | A | 11/2000 | Marks | |
| 6,152,347 | A | 11/2000 | Wilson et al. | |
| D437,754 | S | 2/2001 | Jacquet | |
| 6,789,719 | B2 * | 9/2004 | Shor | 227/132 |
| 2004/0232192 | A1 | 11/2004 | Marks | |
| 2005/0139631 | A1 * | 6/2005 | Marks | 227/134 |

FOREIGN PATENT DOCUMENTS

| | | | |
|---|---|---|---|
| DE | 28 56 621 | A1 | 7/1980 |
| DE | 197 12 849 | A1 | 10/1998 |
| DE | 19712849 | A1 | 10/1998 |
| DE | 101 38 447 | A1 | 7/2003 |
| DE | 10138447 | A1 | 7/2003 |
| DE | 102 25 816 | A1 | 1/2004 |
| DE | 10225816 | A1 | 1/2004 |
| GB | 2 032 327 | A | 5/1980 |
| GB | 2 229 129 | A | 9/1990 |

* cited by examiner

SPRING ENERGIZED STAPLER LEVER FULCRUM IN LOW POSITION

FIELD OF THE INVENTION

The present relates to desktop staplers. More precisely the present invention relates to geometry of a pivotal mounting of an actuating lever within a spring-powered stapler.

BACKGROUND OF THE INVENTION

In a common spring powered stapler a handle is linked to a rear end of a lever, and the front end of the lever is linked to a striker. Pressing the handle causes the lever to pivot about a lever fulcrum. According to one design the front end of the lever moves upward in an arcing motion so that the lever moves rearward as the lever front end approaches its upper limit. At a predetermined position of the lever the striker is disengaged from the lever. The striker then moves downward from the bias of a power spring to eject a staple from the stapler.

U.S. Pat. No. 5,988,478 (Marks) shows a lever and a power spring where each respective component has a separate and distinct fulcrum. U.S. Pat. No. 6,145,728 (Marks) shows a staple gun where a power spring and a lever share a common fulcrum. The lever is a "U" channel design and the power spring is an elongated flat spring. The shared fulcrum provides minimal net force on the fulcrum and thus internal forces since the lever and spring press with approximately equal and opposite forces on the fulcrum. Especially when plastic material is used it is desirable to limit internal forces in the stapler to minimize distortion of the housing. U.S. Patent Application Publication US2004/0232192 (Marks) shows a further design where the power spring is a dual, co-axial, coiled torsion spring and the lever is a vertically flat metal form. In these references the lever releasably engages an opening in the striker. The lever front end includes an upper position near the top of the housing body. The lever fulcrum is lower than this upper position end position; therefore the lever front end will move in an arcing motion rearward to pull out of the opening in the striker and disengage the striker. This action comprises the release action. At the upper position of the striker a staple on a guide track advances to be under the striker. The power spring forces the striker downward to eject the staple under the striker.

In these designs it is important that the release action occurs at a consistent position of the lever. If the release is too early the striker will not raise high enough to allow the staple to advance. If the release is too late it may not occur at all, the striker will reach its upper limit before the lever moves rearward out of engagement with the striker. To provide a reliable release point the lever fulcrum should be well below the upper most position of the lever front end. The resulting geometry provides a relatively large rearward motion of the lever at the release point with respect to the upward motion. With a large rearward motion the design will not be overly sensitive to manufacturing variations; the release occurs within a small vertical range of motion of the striker.

In a vertically compact design the power spring and lever must be as near as possible to each other vertically. Further the total vertical motion of the striker will be limited. When the lever and spring share a fulcrum the spring is under the fulcrum since the spring presses upward. In the Marks '728 patent, the fulcrum is a round post. A flat power spring presses the post tangentially under the post. The lever pivots around the center of this post. The lever pivot location is therefore spaced above the spring by the radius of the post.

SUMMARY OF THE INVENTION

In the present invention a lever pivots about a lowest possible fulcrum position so that the lever front end is as high as possible above the fulcrum when the lever is at the release point. As discussed above, this design tends toward a reliable release condition. According to the invention a lever and flat power spring share a fulcrum post. The fulcrum post includes a flat rear face that extends down to be adjacent to the power spring. Near the release point the lever presses this flat face at a location immediately adjacent to the spring. The lever pivot is then in the lowest possible position.

According to one embodiment the lever fulcrum is partly cylindrical and partly flat. The flat portion extends away from the cylindrical portion to form an extended cam. The lever fulcrum fits in a notch of the lever. The lever pivots at the notch about a central axis of the cylindrical part of the fulcrum through a lower range of motion of the lever. As the lever moves upward, at the lever front end, to approach the release point the notch moves to press the extended cam of the flat portion. The lever then moves more quickly rearward to reliably disengage from the striker.

DETAILED DESCRIPTION OF THE PREFERRED EMBODIMENTS

Figure 1:
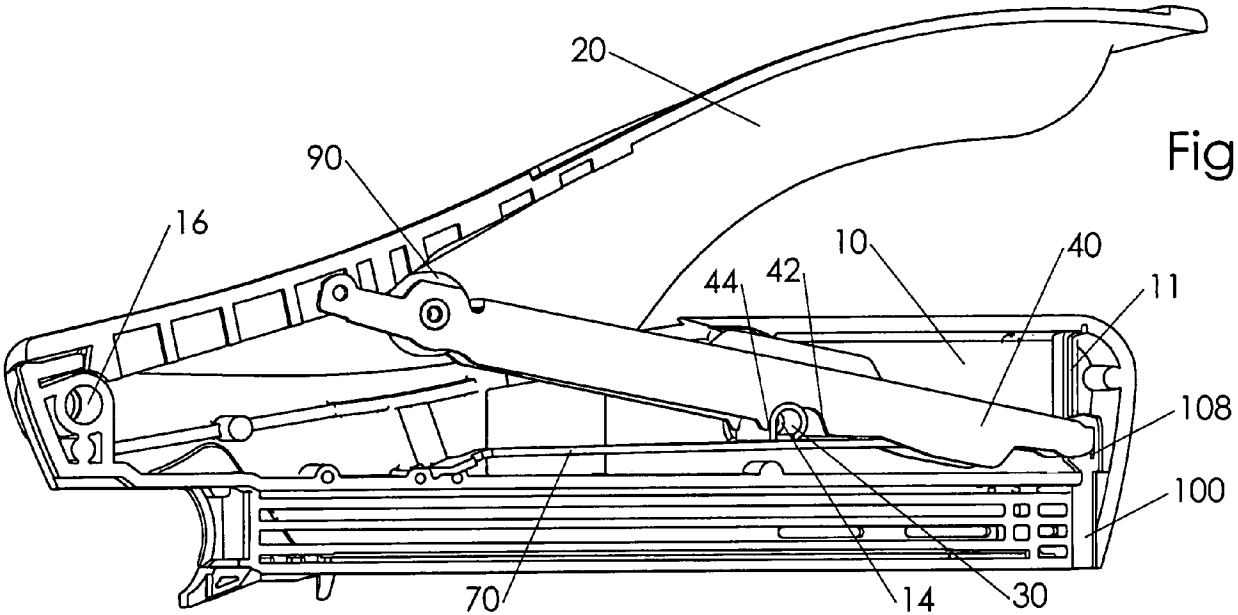
FIG. 1 is a side, rear perspective view of selected components of a stapler according to the invention, with the illustrated parts in an initial position.
Figure 2:
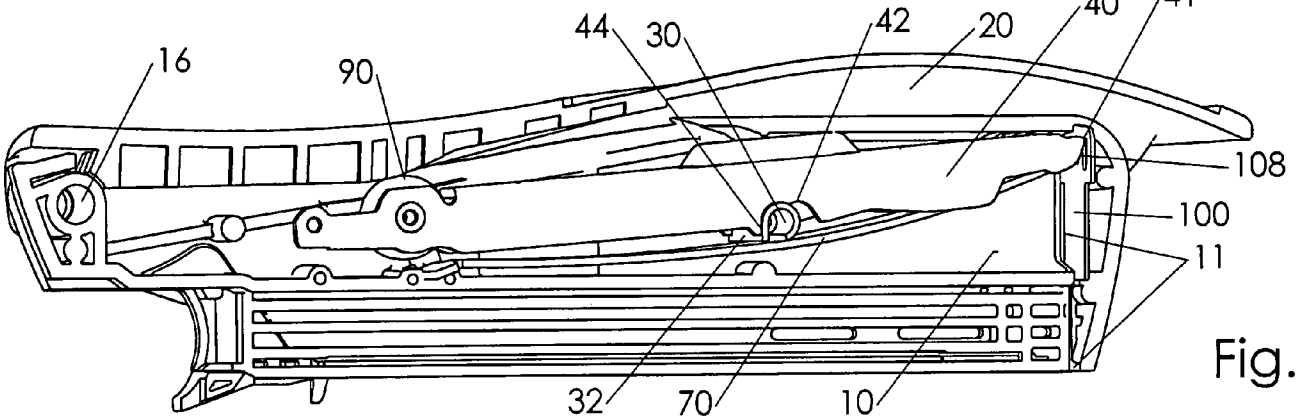
FIG. 2 is the stapler of FIG. 1 with the components in a release point position.
Figure 3:
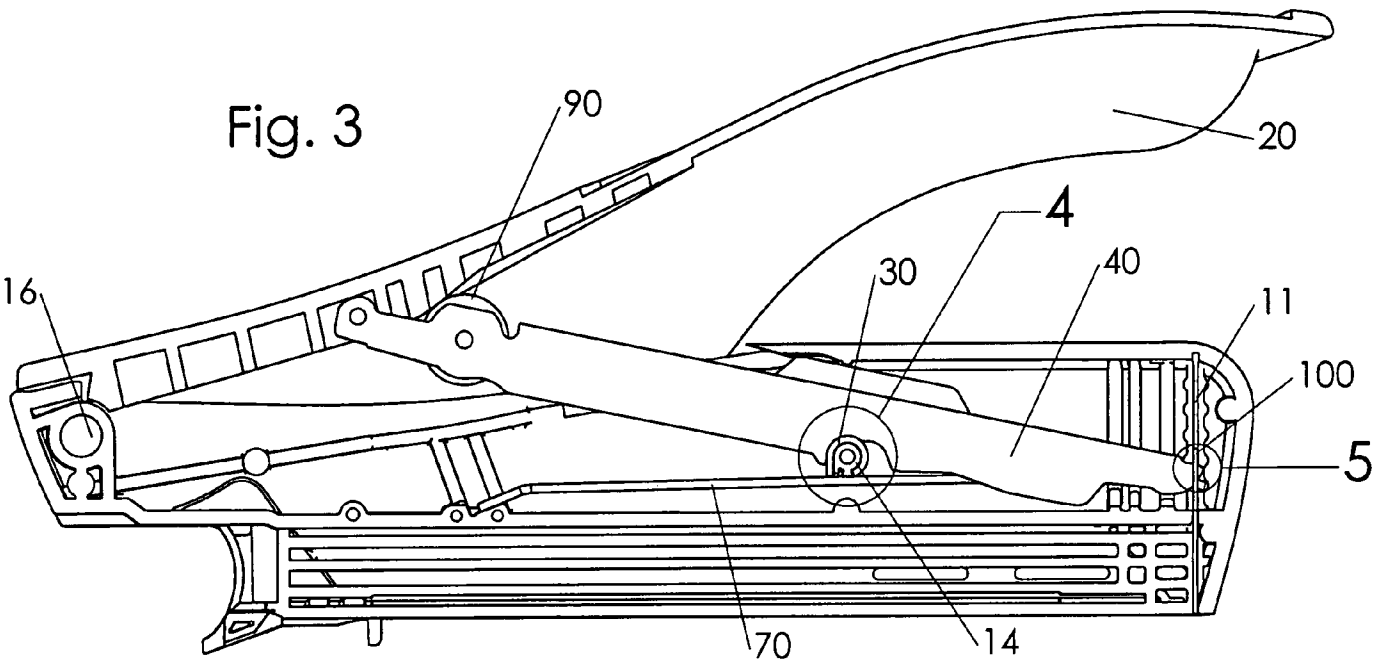
FIG. 3 is a side elevation of the stapler of FIG. 1.
Figure 5:
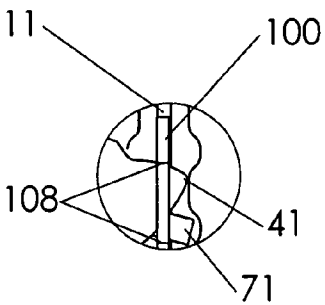
FIG. 5 is a detail view of the striker and lever engagement area of the stapler of FIG. 3.
Figure 6:
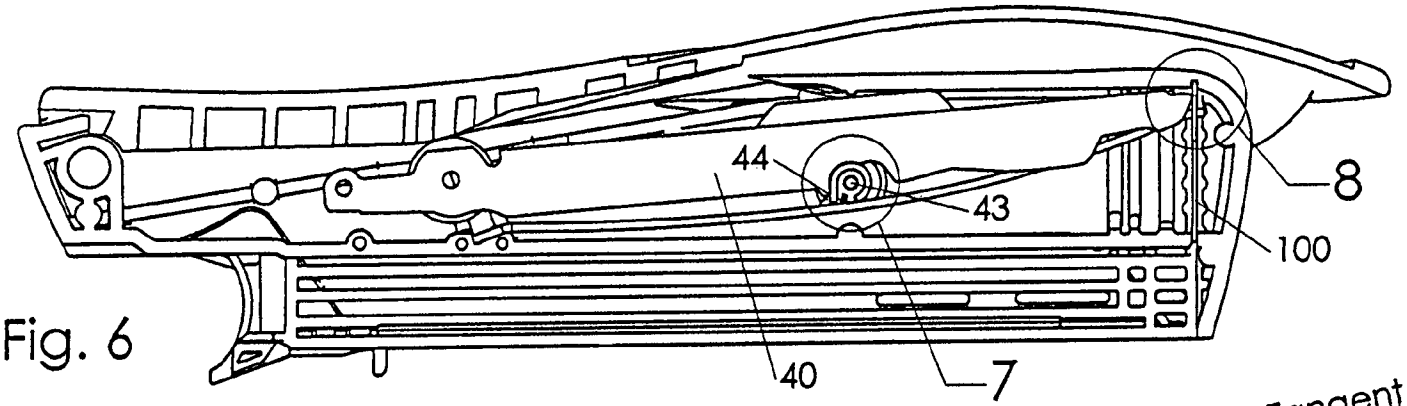
FIG. 6 is a side elevation of the stapler of FIG. 2.
Figure 8:
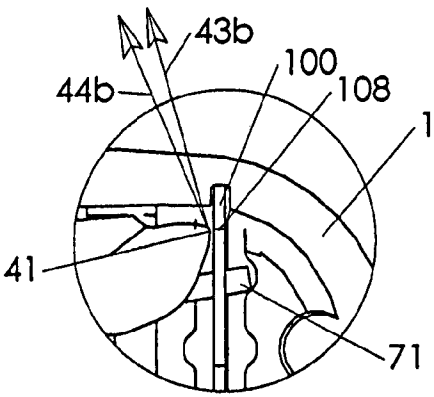
FIG. 8 is a detail view of the striker and lever engagement area of the stapler of FIG. 6.

In the Figures only selected parts of a stapler are shown for clarity. These include left housing half 10, handle 20, lever 40, fulcrum sleeve 30, power spring 70, wheel 90, and striker 100. Striker 100 is vertically movable within housing 10. FIGS. 1 and 3 show these components of the stapler in an initial rest position. Handle 20 is linked to lever 40 through optional low friction wheel 90. As handle 20 is pressed the mechanism approaches the configuration of FIGS. 2 and 6. Lever 40 is forced to rotate counterclockwise so that release end 41 of the lever moves upward. Power spring 70 engages an opening, not shown, in striker 100 at spring tip 71, FIGS. 5 and 8. Power spring 70 deflects about fulcrum sleeve 30. Fulcrum sleeve 30 surrounds fulcrum post 14 of housing 10. A "lever fulcrum" refers generally to the fulcrum position defined by the location on fulcrum sleeve 30 that lever 40 pivots. Lever release end 41 moves in an arcing motion about the lever fulcrum. As the lever rises above the lever fulcrum, release end 41 retracts rearward out of slot 108 of striker 100 as a result of the arcing motion. At a predetermined rearward position of lever release end 41 the lever will disengage from the striker and the striker will be driven downward from the urging of power spring 70. This predetermined position is the release point shown in FIGS. 2, 6 and 8. In FIG. 8 it is visible that lever release end 41 has moved rearward to release striker 100. The space between release end 41 and striker 100 is exaggerated for clarity.

At a selected vertical position of striker 100 the upward speed of the striker corresponds to a rearward speed of retraction of the lever. A faster retraction speed makes the release point less sensitive to the vertical position of striker 100. The retraction speed becomes faster as the lever front end, including release end 41, rises higher above the lever fulcrum as a result of the tangent direction of the arc described by the motion of lever end 41. However if the retraction speed is excessive there will be more sliding and friction than necessary between lever 40 and striker 100 as lever release end 41 pulls out from slot 108. Therefore there should be just enough retraction speed to match the release sensitivity to the manufacturing tolerances of the stapler.

Figure 4:
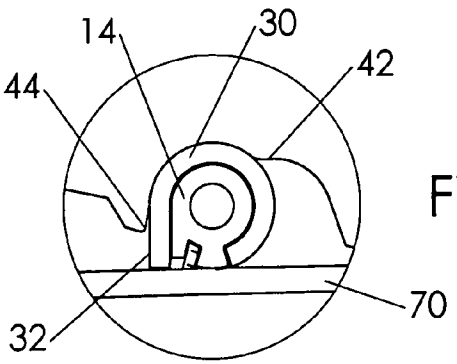
FIG. 4 is a detail view of the fulcrum area of the stapler of FIG. 3.
Figure 9:
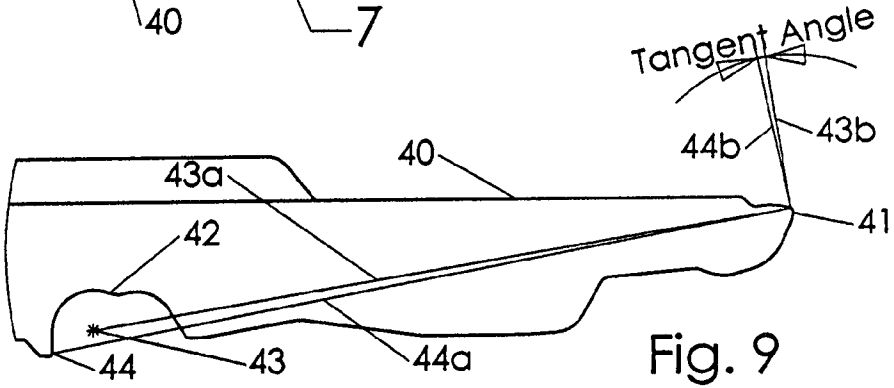
FIG. 9 is a detail view of the front portion of a lever.
Figure 10:
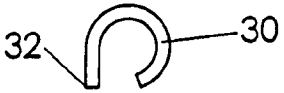
FIG. 10 is an end view of a post sleeve.

In the illustrated stapler the very compact design includes a geometry of the lever and power spring such that fulcrum post 14 has an axial center vertically close to lever release end 41. If the lever fulcrum is at this axial center the release end will not be as high as possible above the lever fulcrum. Then the retraction speed may not be fast enough for a reliable release. It is desirable to have the lever fulcrum at a lower position. In FIG. 4 it is seen that lever notch 42 rotates about the axial center, or more precisely the cylindrical portion, of fulcrum sleeve 30. The structure of the lever fulcrum may not include a precisely cylindrical portion; "axial center" may refer to a general center of a fulcrum structure. The axial center is spaced above the power spring with a substantial portion of the fulcrum structure between the axial center and the power spring. This axial center corresponds to notch center 43 of lever 40, FIG. 9. In FIG. 9 radial line 43*a* connects notch center 43 to release end 41. Tangent angle line 43*b* is perpendicular to radial line 43*a*. Tangent line 43*b* describes the direction of travel of release end 41 for a particular angular position of lever 40 when the lever fulcrum is at notch center 43.

Figure 7:
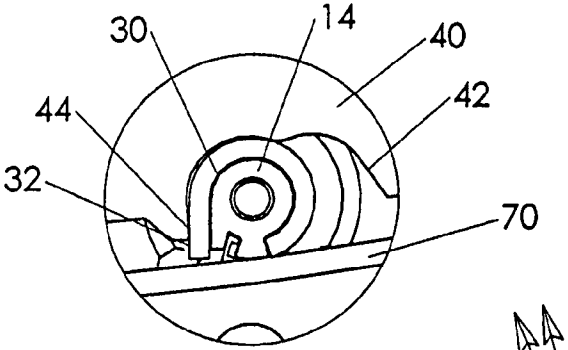
FIG. 7 is a detail view of the fulcrum area of the stapler of FIG. 6.

In FIG. 7 corner 44 of notch 42 is pressing rearward facing flat 32 of fulcrum sleeve 30 at a position below the axial center. From this engagement the lever fulcrum has traveled from notch center 43 to notch corner 44, FIG. 9. Radial line 44*a* connects notch corner 44 to release end 41. Tangent line 44*b* is perpendicular to radial line 44*a*. In FIG. 9 it is seen that tangent line 44*b* is angled more rearward than tangent line 43*b*, with the difference noted as "tangent angle". Release end 41 therefore has a stronger rearward component to its direction when the lever fulcrum is at notch corner 44. In FIG. 7 notch corner 44 and the corresponding lever fulcrum are nearly adjacent to power spring 70, while notch center 43 is spaced further above the power spring. Flat 32 extends downward to be adjacent to power spring 70.

The structures of fulcrum post 14 and fulcrum sleeve 30 are large enough to secure lever 40 through its pivoting motion. However according to the invention it is not required that the lever always pivot about the axis described by the generally cylindrical shape of fulcrum sleeve 30. Rather the lever pivots about a rear, generally flat, face of the fulcrum sleeve for at least some positions of the lever. In this manner the lever can pivot as low as possible, immediately near the power spring at the bottom of the structure of the fulcrum post and sleeve. When notch corner 44 presses forward on flat 32 of fulcrum sleeve 30, the lever is urged rearward to quickly retract from striker 100.

In the illustrated embodiment the lever engages the fulcrum sleeve in two ways. A first pivot point is substantially downward about the cylindrical axis of fulcrum sleeve 30 for an initial range of motion of the lever. Near the release point the pivot location is at a lower position pressing forward against flat 32. Optionally notch corner 44 may press flat 32 through most or all of the range of motion of the lever. In either case, at or near the release point, the lever pivots about a lowest possible position adjacent to power spring 70.

What is claimed is:

1. A stapler including a housing, a striker vertically movable within the housing, a power spring linked to the striker, and a lever releasably linked to the striker wherein:

the lever pivots upon a lever fulcrum from an initial rest position toward a release point of the striker and lever, a release end of the lever engaging a slot of the striker as the lever pivots toward the release point whereby the striker is raised to the release point;

the release end of the lever including an arcing motion about the fulcrum as the lever pivots upon the fulcrum, the release end retracting out of the slot as the lever and striker approach the release point;

the fulcrum includes a curved surface having an axial center and a rearward facing flat surface with respect to the lever release end extending to be adjacent to the power spring, and at the lever release point the lever having a notch corner apex that pivots on the rearward facing flat surface adjacent to the power spring, at a bottom of the fulcrum below the axial center.

2. The stapler of claim 1 wherein the lever pivots about the axial center, and the lever pivots adjacent to the power spring at the release point.

3. The stapler of claim 2 wherein the fulcrum includes a cylindrical portion and the rearward-facing surface is a flat portion of the fulcrum.

4. The stapler of claim 3 wherein the fulcrum includes a fulcrum post, and a fulcrum sleeve surrounds the fulcrum post, the fulcrum sleeve includes the flat portion of the fulcrum.

5. A stapler including a housing, a striker vertically movable within the housing, a power spring linked to the striker, and a lever releasably linked to the striker wherein:

the lever pivots upon a lever fulcrum from an initial rest position toward a release point of the striker and lever, a release end of the lever engaging a slot of the striker as the lever pivots toward the release point whereby the striker is raised to the release point;

the release end of the lever including an arcing motion about the fulcrum as the lever pivots upon the fulcrum, the release end retracting out of the slot as the lever and striker approach the release point;

the fulcrum includes a cylindrical structure with an axial center of the cylindrical structure, a rearward facing flat surface with respect to the lever release end extending from the cylindrical structure to be adjacent to the power spring, the lever pivots about the axial center through an initial range of motion of the lever, and the lever having a notch corner apex that pivots on the rearward facing flat surface, adjacent to the power spring, at a release point position of the lever.

6. A stapler, comprising:

a housing;

a striker vertically movable within the housing;

a power spring linked to the striker;

a handle pivotably attached at a rear of the housing;

a lever releasably linked to the striker wherein the handle is linked to the lever toward a rear end of the lever;

a lever fulcrum fixed within the housing and having a rearward facing flat surface with respect to a forward end of the lever extending downward to immediately adjacent the power spring;

wherein the lever pivots within the housing immediately adjacent the power spring about the flat, rearward surface of the fulcrum, and a release end of the lever engages a slot of the striker as the lever pivots toward a release point whereby the striker is raised to the release point; and wherein the fulcrum pivots against the lever at a location between the handle linkage and the release end of the lever.

* * * * *